US010089952B2

(12) United States Patent
Nam et al.

(10) Patent No.: US 10,089,952 B2
(45) Date of Patent: Oct. 2, 2018

(54) DISPLAY DEVICE

(71) Applicant: Samsung Display Co., Ltd., Yongin-si, Gyeonggi-do (KR)

(72) Inventors: Yanguk Nam, Seoul (KR); Youngil Ban, Hwaseong-si (KR); Sunkyu Son, Suwon-si (KR); Sunkoo Kang, Seoul (KR); Taegon Kim, Busan (KR)

(73) Assignee: Samsung Display Co., Ltd., Yongin-si (KR)

( * ) Notice: Subject to any disclaimer, the term of this patent is extended or adjusted under 35 U.S.C. 154(b) by 148 days.

(21) Appl. No.: 15/173,392

(22) Filed: Jun. 3, 2016

(65) Prior Publication Data

US 2016/0365058 A1 Dec. 15, 2016

(30) Foreign Application Priority Data

Jun. 11, 2015 (KR) ..... 10-2015-0082673

(51) Int. Cl.
*G09G 5/10* (2006.01)
*G09G 3/36* (2006.01)
*G09G 3/20* (2006.01)

(52) U.S. Cl.
CPC ..... *G09G 3/3688* (2013.01); *G09G 3/2096* (2013.01); *G09G 3/3614* (2013.01); *G09G 3/3696* (2013.01); *G09G 2300/08* (2013.01); *G09G 2320/0673* (2013.01); *G09G 2330/021* (2013.01); *G09G 2330/04* (2013.01);
(Continued)

(58) Field of Classification Search
USPC ... 345/204, 212, 211, 213, 690, 691, 76, 89, 345/90
See application file for complete search history.

(56) References Cited

U.S. PATENT DOCUMENTS

2006/0244692 A1* 11/2006 Yoo ..... G09G 3/3225 345/76
2007/0188430 A1* 2/2007 Moon ..... G09G 3/3648 345/89
(Continued)

FOREIGN PATENT DOCUMENTS

JP 2012-114977 A 6/2012
KR 10-0588139 B1 6/2006
(Continued)

*Primary Examiner* — Thuy Pardo
(74) *Attorney, Agent, or Firm* — Lewis Roca Rothgerber Christie LLP

(57) ABSTRACT

There is provided a display device including a power management integrated circuit outputting a driving voltage and a gamma voltage, a timing controller outputting an image data signal and a driving control signal, a data driver converting the image data signal to a data voltage signal based on the driving voltage, the gamma voltage, and the driving control signal, a power connecting portion connecting the power management integrated circuit and the data driver, a voltage detector detecting the driving voltage and the gamma voltage that are voltage-dropped in the power connecting portion, and outputting a feedback signal, and a power adjustor receiving the feedback signal and outputting a power control signal to the power management integrated circuit, and adjusting the driving voltage and the gamma voltage based on the power control signal.

18 Claims, 9 Drawing Sheets

(52) U.S. Cl.
CPC ..... *G09G 2330/12* (2013.01); *G09G 2360/16* (2013.01); *G09G 2370/047* (2013.01)

(56) References Cited

U.S. PATENT DOCUMENTS

| | | | | |
|---|---|---|---|---|
| 2012/0056864 | A1* | 3/2012 | Aioanei | G09G 3/3696 345/212 |
| 2012/0127151 | A1 | 5/2012 | Murakami | |
| 2014/0160182 | A1* | 6/2014 | Hong | G09G 3/3696 345/691 |
| 2014/0168043 | A1* | 6/2014 | Zhang | G09G 3/3692 345/90 |
| 2014/0253535 | A1* | 9/2014 | Lim | G09G 5/008 345/213 |
| 2015/0279304 | A1* | 10/2015 | Yoneyama | G06T 1/60 345/211 |
| 2015/0356932 | A1* | 12/2015 | Kim | G09G 3/3688 345/690 |
| 2016/0019827 | A1* | 1/2016 | Lee | G09G 3/3208 345/204 |
| 2016/0078824 | A1* | 3/2016 | Meador | G09G 3/3433 345/212 |

FOREIGN PATENT DOCUMENTS

| | | | |
|---|---|---|---|
| KR | 10-1410955 | B1 | 7/2014 |
| KR | 10-1463617 | B1 | 11/2014 |

* cited by examiner

DISPLAY DEVICE

CROSS-REFERENCE TO RELATED APPLICATION

This application claims priority to and the benefit of Korean Patent Application No. 10-2015-0082673, filed on Jun. 11, 2015, with the Korean Intellectual Property Office, the disclosure of which is incorporated herein in its entirety by reference.

BACKGROUND

1. Field

Aspects of embodiments of the present invention relate to a display device capable of enhancing reliability.

2. Description of the Related Art

Display devices display images using elements that emit light. In recent times, flat panel display ("FPD") devices are used in a wide range of applications. The FPD devices are classified into liquid crystal display ("LCD") devices, organic light emitting diode ("OLED") display devices, plasma display panel ("PDP") devices, electrophoretic display ("EPD") devices, or the like, based on their respective light emitting scheme.

In general, a display device includes a gate driver driving gate lines, a data driver driving data lines, a timing controller ("T-CON") controlling the gate driver and the data driver, and a power management integrated circuit ("PMIC") generating a driving voltage and a gamma voltage.

The driving voltage and the gamma voltage are output from the PMIC to be applied to the data driver through a connecting portion. In this regard, the driving voltage and the gamma voltage are set to have an appropriate voltage level in the PMIC in consideration of conditions such as an electro-optical activation layer and the size of a display panel that are used in manufacturing of the display device.

However, due to a parasitic resistance caused in the connecting portion that connects the PMIC and the data driver, a voltage drop of the driving voltage and the gamma voltage may occur in the connecting portion. Further, as the size of the display panel is increased, there may be a lack of output capacity in the driving voltage output from the PMIC.

Accordingly, the driving voltage applied to the data driver may have a voltage level less than the voltage level of the driving voltage output from the PMIC. However, because a driving circuit is designed to have a driving voltage that is invariably higher in voltage level than each of the plurality of gamma voltages, in a case where a potential reversal (in which the gamma voltage is higher than the driving voltage) occurs due to the voltage drop, the driving circuit may be damaged.

It is to be understood that this background of the technology section is intended to provide useful background for understanding the technology and as such disclosed herein, the technology background section may include ideas, concepts or recognitions that were not part of what was known or appreciated by those skilled in the pertinent art prior to a corresponding effective filing date of subject matter disclosed herein.

SUMMARY

Aspects of embodiments of the present invention are directed toward a display device capable of preventing (or protecting from) damage to a data driver by automatically adjusting a driving voltage and/or a gamma voltage.

According to some exemplary embodiments of the present invention, there is provided a display device including: a power management integrated circuit configured to output a driving voltage and a gamma voltage, the gamma voltage being less than the driving voltage; a timing controller configured to output an image data signal and a driving control signal; a data driver configured to convert the image data signal to a data voltage signal based on the driving voltage, the gamma voltage, and the driving control signal; a power connecting portion configured to connect the power management integrated circuit and the data driver; a voltage detector configured to detect the driving voltage and the gamma voltage that are voltage-dropped in the power connecting portion, and to output a feedback signal; and a power adjustor configured to receive the feedback signal and to output a power control signal to the power management integrated circuit, the power management integrated circuit being further configured to adjust the driving voltage and the gamma voltage based on the power control signal.

In an embodiment, the feedback signal is a voltage difference between the voltage-dropped driving voltage and the voltage-dropped gamma voltage.

In an embodiment, the power adjustor includes: a memory configured to store a reference voltage difference and a reference count number; a counter configured to calculate a count number by counting each instance of the feedback signal being less than the reference voltage difference; and a power control signal generator configured to output the power control signal when the count number is greater than the reference count number.

In an embodiment, the counter is configured to initiate the count number for each frame.

In an embodiment, the counter is configured to calculate the count number for each period of a horizontal synchronization signal.

In an embodiment, the power management integrated circuit is configured to receive the power control signal and to increase the voltage difference between the driving voltage and the gamma voltage in a single frame.

In an embodiment, the power management integrated circuit is configured to increase the driving voltage or to decrease the gamma voltage.

In an embodiment, the power management integrated circuit is configured to initiate the driving voltage and the gamma voltage after a single frame ends.

In an embodiment, the power management integrated circuit further includes an additional power supply configured to increase power capacity of the driving voltage in response to the power control signal.

In an embodiment, the additional power supply is configured to initiate the power capacity of the driving voltage after a single frame ends.

In an embodiment, the voltage detector includes a first memory configured to store a reference voltage difference and output the feedback signal when the voltage difference between the driving voltage and the gamma voltage that are voltage-dropped is less than the reference voltage difference.

In an embodiment, the feedback signal is a logic signal having a high value or a low value.

In an embodiment, the power adjustor includes: a second memory configured to store a reference count number; a counter configured to count a count number in response to the feedback signal; and a power control signal generator configured to output the power control signal when the count number is greater than the reference count number.

In an embodiment, the counter is configured to initiate the count number for each frame.

In an embodiment, the power management integrated circuit is configured to receive the power control signal and to increase the voltage difference between the driving voltage and the gamma voltage in a single frame.

In an embodiment, the power management integrated circuit is configured to increase the driving voltage or to decrease the gamma voltage.

In an embodiment, the power management integrated circuit is configured to initiate the driving voltage and the gamma voltage after a single frame ends.

In an embodiment, the power management integrated circuit further includes an additional power supply configured to increase power capacity of the driving voltage in response to the power control signal.

In an embodiment, the additional power supply is configured to initiate the power capacity after a single frame ends.

In an embodiment, the power adjustor includes a serial interface configured to transmit and/or receive the feedback signal and the power control signal in a serial communication scheme.

The foregoing is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

The above and other features and aspects of the present disclosure of invention will be more clearly understood from the following detailed description taken in conjunction with the accompanying drawings, in which.

DETAILED DESCRIPTION

Aspects and features of the present invention and methods for achieving them will be made clear from embodiments described below in more detail with reference to the accompanying drawings.

Unless otherwise defined, all terms used herein (including technical and scientific terms) have the same meaning as commonly understood by those skilled in the art to which this invention pertains. It will be further understood that terms, such as those defined in commonly used dictionaries, should be interpreted as having a meaning that is consistent with their meaning in the context of the relevant art and will not be interpreted in an ideal or excessively formal sense unless clearly defined in the present specification.

Hereinafter, a display device according to exemplary embodiments will be described in more detail with reference to FIGS. 1 to 8. Meanwhile, terms and names of elements used herein are chosen for ease of description and may differ from names used in actual products.

Figure 1:
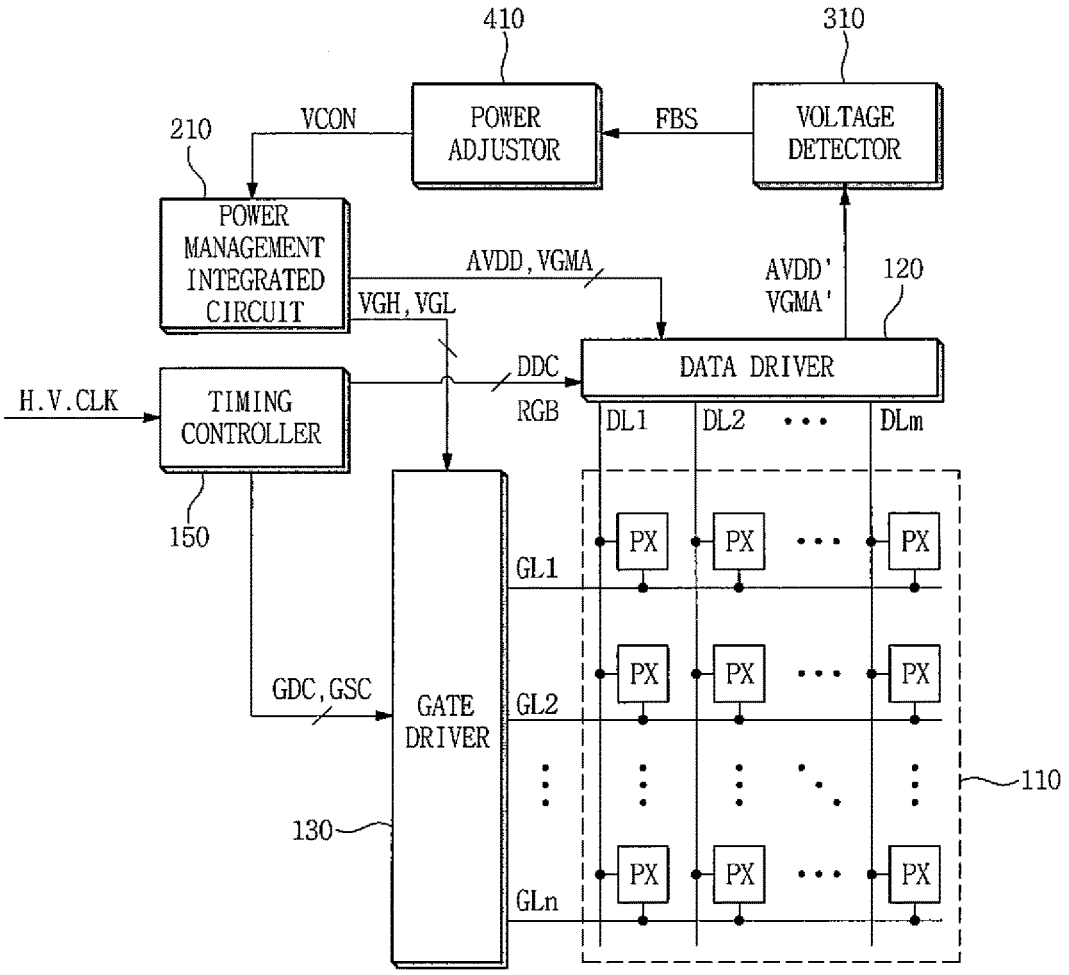
FIG. 1 is a block diagram illustrating a driving device of a display device according to an exemplary embodiment of the present invention.
Figure 2:
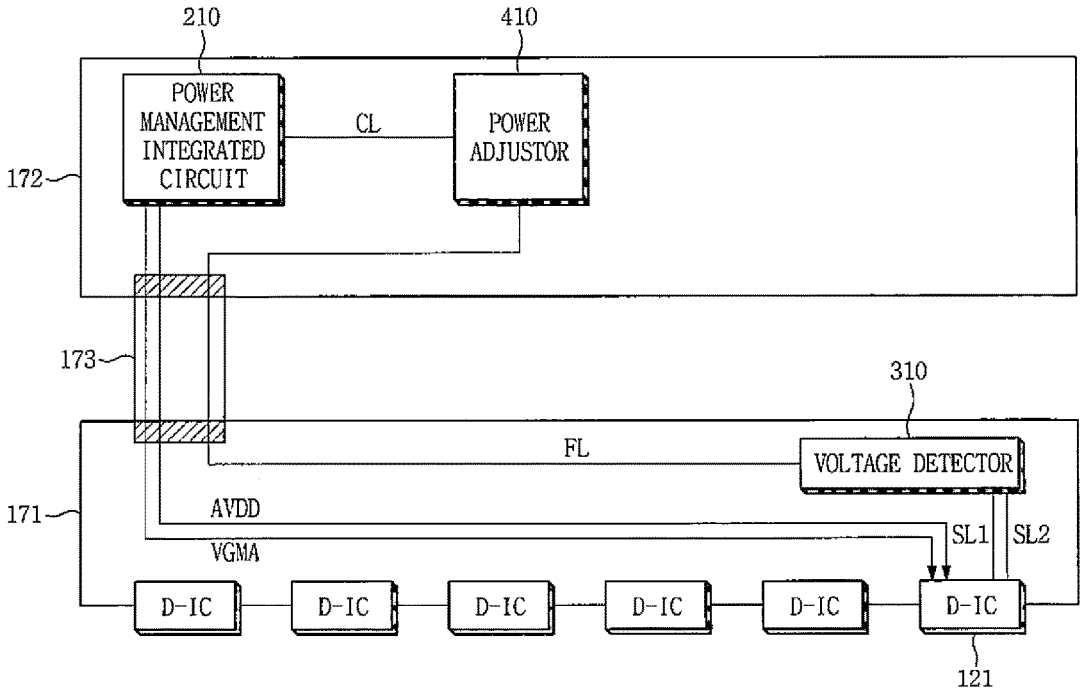
FIG. 2 is a block diagram illustrating a control board and a source board of the display device according to the exemplary embodiment of the present invention.

FIG. 1 is a block diagram illustrating a driving device of a display device according to an exemplary embodiment of the present invention. FIG. 2 is a block diagram illustrating a control board and a source board of the display device according to the exemplary embodiment of the present invention.

As illustrated in FIG. 1, the display device according to the exemplary embodiment includes a display panel 110, a data driver 120, a gate driver 130, a timing controller ("T-CON") 150, a power management integrated circuit ("PMIC") 210, a voltage detector 310, and a power adjustor 410.

The display device including the display panel 110 may further include a backlight unit providing light to the display panel 110 and a pair of polarizers. In addition, in a case where the display panel 110 is provided as a liquid crystal display ("LCD") panel, the LCD panel may be in one of the following modes: a vertical alignment (VA) mode, a patterned vertical alignment (PVA) mode, an in-plane switching (IPS) mode, a fringe-field switching (FFS) mode, and a plane to line switching (PLS) mode. However, the mode of the display panel 110 is not particularly limited.

The display panel 110 includes a plurality of gate lines GL1-GLn, a plurality of data lines DL1-DLm insulated from and crossing the plurality of gate lines GL1-GLn, a plurality of pixels PX electrically connected to the plurality of gate lines GL1-GLn and the plurality of data lines DL1-Dlm. The plurality of gate lines GL1-GLn are connected to the gate driver 130, and the plurality of data lines DL1-DLm are connected to the data driver 120.

The data driver 120 includes a plurality of data driving integrated circuits ("ICs") 121. The data driving ICs 121 receive a digital image data signal RGB and a data driving control signal DDC from the T-CON 150. The data driving ICs 121 sample the digital image data signal RGB in response to the data driving control signal DDC, latch the sampled image data signal corresponding to one horizontal line every horizontal period, and supply the latched image data signal to the data lines DL1 to DLm. That is, the data driving ICs 121 convert the digital image data signals RGB applied from the T-CON 150 into analog image signals using a driving voltage AVDD and a gamma voltage VGMA applied from the PMIC 210, and supply the analog image signals to the data lines DL1 to DLm.

The plurality of data driving ICs 121 may each be provided in a tape carrier package ("TCP"), as a chip on film ("COF"), or the like. In alternative exemplary embodiments, the data driving ICs 121 may be directly mounted on the display panel 110.

The gate driver 130 receives gate driving voltages VGH and VGL from the PMIC 210, and receives a gate driving control signal GDC and a gate shift clock GSC from the T-CON 150. The gate driver 130 sequentially generates gate pulse signals in response to a gate driving control signal GDC and a gate shift clock GSC, and supplies the gate pulse signals to the gate lines GL1 to GLn.

The T-CON 150 applies the externally input digital image data signal RGB to the data driver 120, generates a data driving control signal DDC and the gate driving control signal GDC using a horizontal synchronization signal H and a vertical synchronization signal V in response to a clock signal CLK, and applies the data driving control signal DDC and the gate driving control signal GDC to the data driver 120 and the gate driver 130, respectively. Herein, the data driving control signal DDC may include a source shift clock, a source start pulse, a data output enable signal, and/or the like; and the gate driving control signal GDC may include a gate start pulse, a gate output enable signal, and/or the like.

As illustrated in FIG. 2, a source board 171 of the display device according to the exemplary embodiment may include a plurality of data driving ICs 121 and the voltage detector 310. In this case, the source board 171 may be a printed circuit board PCB.

The plurality of data driving ICs 121 convert the digital image data signal RGB input from the T-CON 150 into analog image signals using the gamma voltage VGMA input from the PMIC 210, and apply the analog image signals to the data lines DL1 to DLm. The voltage detector 310 detects the driving voltage AVDD and the gamma voltage VGMA applied to the data driving ICs 121, and outputs a feedback signal FBS to the power adjustor 410.

In the exemplary embodiment, although the voltage detector 310 is described as being disposed on the source board 171, the voltage detector 310 may be disposed on the control board 172 or a separate printed circuit board ("PCB"). The source board 171, on which the plurality of data driving ICs 121 and the voltage detector 310 are embedded, may be collectively referred to as a printed board assembly ("PBA").

The T-CON 150, the PMIC 210, and the power adjustor 410 may be disposed on the control board 172. In this case, the control board 172 may be a PCB.

The T-CON 150 outputs the digital image data signal RGB and the driving control signal DDC to the data driving IC 121. The PMIC 210 is a power device configured to generate the driving voltage AVDD and the gamma voltage VGMA, and to apply the driving voltage AVDD and the gamma voltage GVMA to the plurality of data driving ICs 121 and the T-CON 150. The power adjustor 410 receives the feedback signal FBS, and outputs, to the PMIC 210, the power control signal VCON for adjusting the driving voltage AVDD and the gamma voltage VGMA.

In the exemplary embodiment, although the power adjustor 410 is described as being disposed on the control board 172, the power adjustor 410 may be disposed on the source board 171 or a separate PCB. The control board 172 on which the T-CON 150, the PMIC 210, and the power adjustor 410 are embedded may be collectively referred to as a PBA.

The source board 171 and the control board 172 may be connected by a connecting cable 173. The connecting cable 173 may be provided as a flexible flat cable ("FFC"). In the present exemplary embodiment, a single connecting cable 173 is provided by way of example, but the number of the connecting cable 173 is not limited thereto. In an alternative exemplary embodiment, the source board 171 and the control board 172 may be connected by two or more connecting cables 173.

A first detecting line SL1 and a second detecting line SL2 configured to connect the data driving IC 121 to the voltage detector 310 is disposed on the source board 171. A feedback line FL configured to connect the voltage detector 310 to the power adjustor 410 is disposed on the source board 171, the control board 172, and the connecting cable 173. A power control line CL configured to connect the power adjustor 410 to the PMIC 210 is disposed on the control board 172.

As illustrated in FIGS. 1 and 2, when the display device is operated, the PMIC 210 outputs the driving voltage AVDD and the gamma voltage VGMA having a preset or predetermined voltage level. The driving voltage AVDD and the gamma voltage VGMA are applied to the data driving IC 121 of the data driver 120 through a connecting portion. In this case, a voltage drop may occur in the driving voltage AVDD and the gamma voltage VGMA. In this regard, the connecting portion may include the source board 171, the control board 172, and the connecting cable 173.

In a case where the voltage-dropped driving voltage AVDD' and the voltage-dropped gamma voltage VGMA' are applied to the data driver 120, the voltage-dropped driving voltage AVDD' and the voltage-dropped gamma voltage VGMA' are applied to the voltage detector 310 through the first detecting line SL1 and the second detecting line SL2.

The voltage detector 310 detects a voltage difference VGAP' between the voltage-dropped driving voltage AVDD' and the voltage-dropped gamma voltage VGMA', and outputs a feedback signal FBS to the feedback line FL. The detected voltage difference VGAP' and a preset or predetermined reference voltage difference VGAP are compared by the voltage detector 310 or the power adjustor 410, and the power adjustor 410 outputs the power control signal VCON through the power control line CL.

Figure 3A:
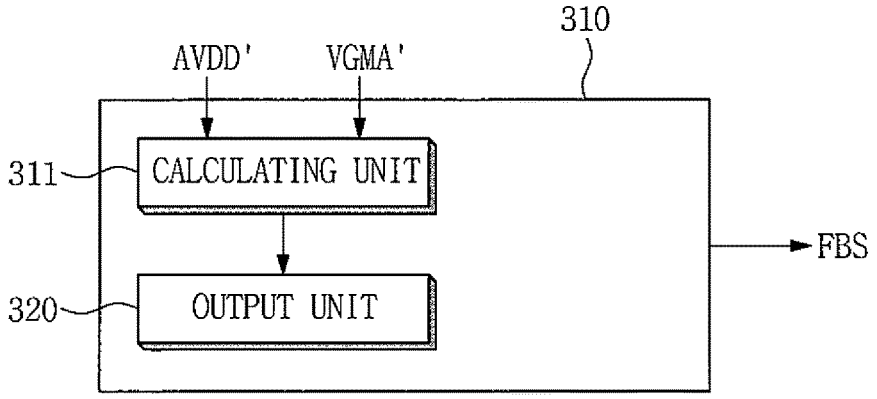
FIG. 3A is a block diagram illustrating a voltage detector of the display device according to the exemplary embodiment of the present invention.
Figure 3B:
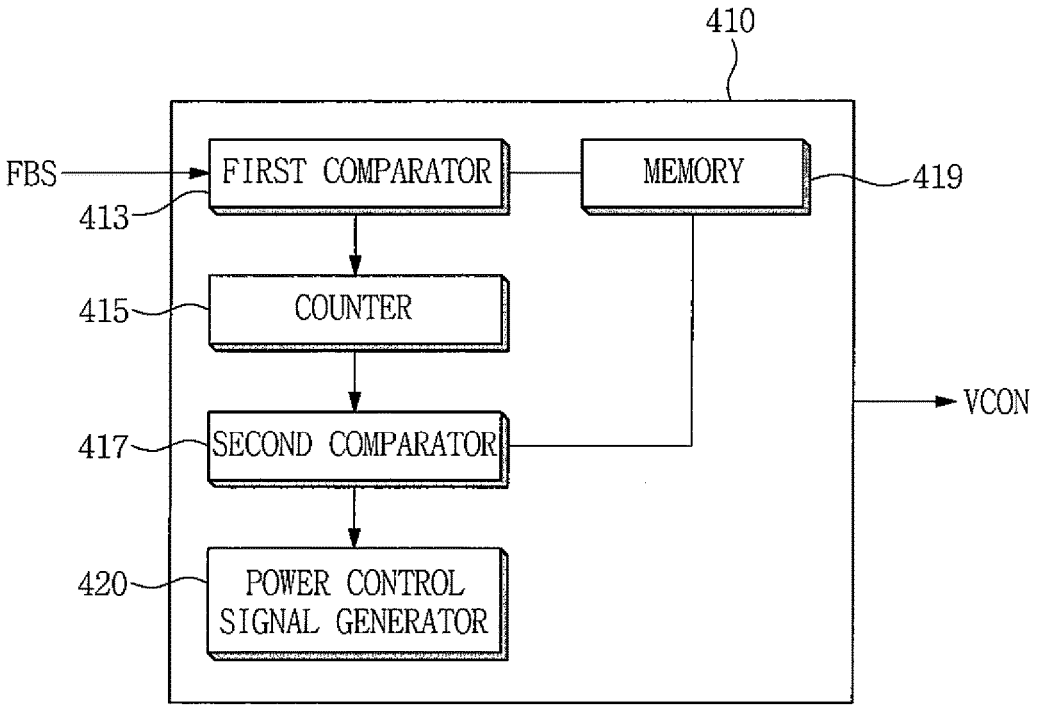
FIG. 3B is a block diagram illustrating a power adjustor of the display device according to the exemplary embodiment of the present invention.
Figure 4A:
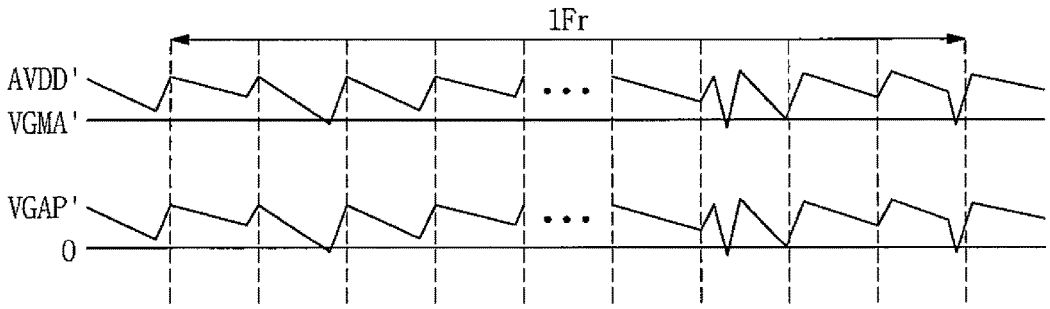
FIGS. 4A-4C are diagrams illustrating waveforms of signals used to adjust a driving voltage and a gamma voltage of the display device according to the exemplary embodiment of the present invention.

FIG. 3A is a block diagram illustrating the voltage detector 310 of the display device according to the exemplary embodiment of the present invention. FIG. 3B is a block diagram illustrating the power adjustor 410 of the display device according to the exemplary embodiment of the present invention. FIGS. 4A4C are diagrams illustrating waveforms of signals used to adjust the driving voltage AVDD and the gamma voltage VGMA of the display device according to the exemplary embodiment of the present invention.

Hereinafter, the exemplary embodiment of the present invention will be described with reference to FIGS. 3A-3B and 4A-4C.

As illustrated in FIGS. 3A and 4A, the voltage detector 310 includes a calculating unit 311 and an output unit 320.

The calculating unit 311 calculates the voltage difference VGAP' between the voltage-dropped driving voltage AVDD' and the voltage-dropped gamma voltage VGMA' input from the data driver 120, and the output unit 320 outputs the voltage difference VGAP' calculated by the calculating unit 311 to the power adjustor 410 as the feedback signal FBS.

Figure 4B:
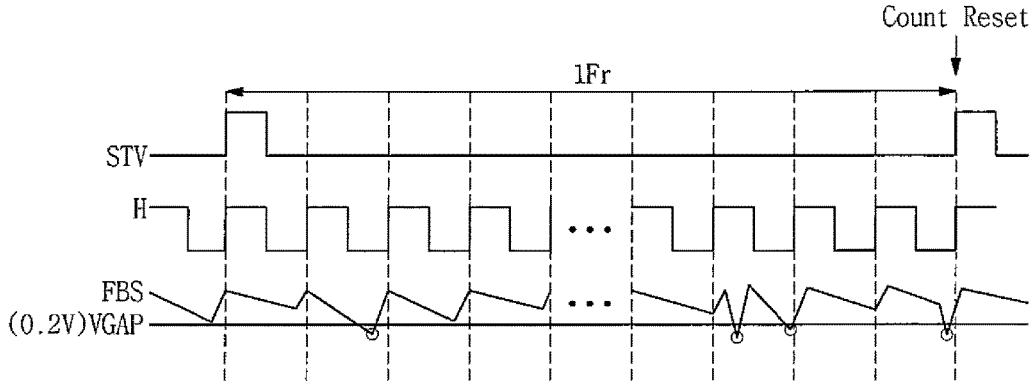
Figure 4C:
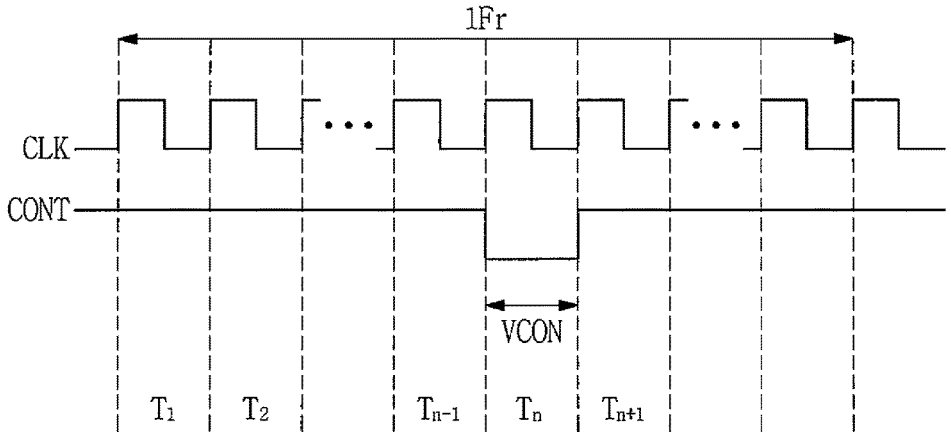

As illustrated in FIGS. 3B and 4B, the power adjustor 410 includes a first comparator 413, a counter 415, a second comparator 417, a memory 419, and a power control signal generator 420.

The first comparator 413 receives the feedback signal FBS from the voltage detector 310, and compares the feedback signal FBS to the reference voltage difference VGAP stored in the memory 419. In the present exemplary embodiment, the reference voltage difference VGAP is described as being about 0.2 V, but the present invention is not limited thereto. In alternative exemplary embodiments, the reference voltage difference VGAP may be set to have other suitable values.

The counter 415 counts cases in which the feedback signal FBS is less than the reference voltage difference VGAP in the first comparator 413 to thereby increase a count number. That is, as illustrated in FIG. 4B, the counter 415 starts counting when an input frame starting signal STV has a high level and initiates the stored count number when a single frame 1Fr ends. In addition, the count number is calculated for each period of the horizontal synchronization signal H, and the counter 415 counts each case in which the feedback signal FBS is less than the reference voltage difference VGAP in the period of the horizontal synchronization signal H. The frame start signal STV may be output from at least one of the T-CON 150, the PMIC 210, and the power adjustor 410.

The second comparator 417 compares the count number calculated by the counter 415 to the reference count number stored in the memory 419. The reference count number may be set in various manners. For example, the reference count number may be set to be two.

The power control signal generator 420 outputs a control signal CONT to the PMIC 210. In this regard, in a case where the calculated count number is greater than the reference count number stored in the memory 419, the power control signal VCON is output to the PMIC 210.

For example, the power control signal generator 420 may generate a high signal in a case where the count number calculated in the second comparator 417 is less than the reference count number stored in the memory 419, generate a low signal in a case where the count number calculated in the second comparator 417 is greater than the reference count number stored in the memory 419, and apply the signal (e.g., high or low signal) to the PMIC 210. In this case, the low signal may be the power control signal VCON.

However, the present exemplary embodiment is not limited thereto, and the power control signal generator 420 may generate a low signal in a case where the count number calculated in the second comparator 417 is less than the reference count number stored in the memory 419, and generate a high signal in a case where the count number calculated in the second comparator 417 is greater than the reference count number stored in the memory 419. In this case, the high signal may be the power control signal VCON.

In addition, as illustrated in FIG. 4C, the power control signal generator 420 may output the power control signal VCON in a preset or predetermined period of the clock signal CLK using the clock signal CLK. For example, the aforementioned power control signal VCON may be preset or predetermined to be output in an $n^{th}$ period $T_n$ of the clock signal CLK. The clock signal CLK may be output from at least one of the T-CON 150, the PMIC 210, and the power adjustor 410.

The PMIC 210 receives the power control signal VCON, and increases the voltage difference between the driving voltage AVDD and the gamma voltage VGMA in a single frame.

The PMIC 210 may increase the driving voltage AVDD or decrease the gamma voltage VGMA so as to increase the voltage difference therebetween. In a case where the power control signal VCON is not additionally applied, the PMIC 210 initiates the driving voltage AVDD and the gamma voltage VGMA after a single frame 1Fr ends, and outputs the driving voltage AVDD and the gamma voltage VGMA that are initially set.

In addition, the PMIC 210 may further include an additional power supply configured to increase power capacity of the driving voltage AVDD. In a case where the voltage drop occurs because the power capacity of the driving voltage AVDD is insufficient as in the case in which a data pattern is a worst pattern, the additional power supply may increase the power capacity of the driving voltage AVDD so as to increase the voltage difference between the driving voltage AVDD and the gamma voltage VGMA. In this regard, in a case where the power control signal VCON is not additionally input to the PMIC 210, the additional power supply initiates the power capacity of the driving voltage AVDD after a single frame 1Fr ends.

Figure 5:
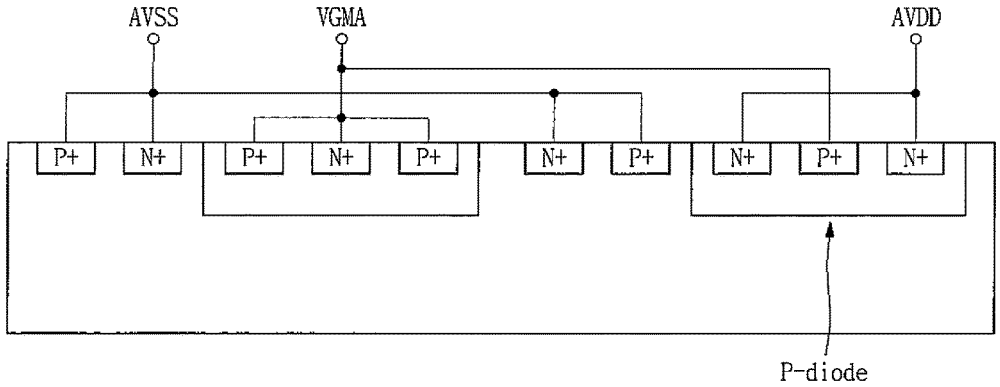
FIG. 5 is a schematic cross-sectional view illustrating a data driver of FIG. 1.

FIG. 5 is a schematic cross-sectional view illustrating the data driver 120 of FIG. 1.

As illustrated in FIG. 5, the data driver 120 may include a p-type diode configured to protect an inner circuit. In the p-type diode, the driving voltage AVDD is applied to an N+ doped area, and the gamma voltage VGMA is applied to a p+ doped area. Herein, in a case where the gamma voltage VGMA has a voltage level higher than the voltage level of the driving voltage AVDD, the p-type diode may be turned on, thus resulting in damage to a portion of the data driver 120.

However, in the display device according to embodiments of the present invention, the driving voltage AVDD or the gamma voltage VGMA output from the PMIC 210 are automatically adjusted so that the voltage difference VGAP' between the voltage-dropped driving voltage AVDD' and the voltage-dropped gamma voltage VGMA' applied to the data driver 120 is greater than the preset or predetermined reference voltage difference VGAP. Thus, the gamma voltage VGMA may have a voltage level invariably less than the voltage level of the driving voltage AVDD in the data driver 120. Accordingly, the p-type diode provided to protect the inner circuit is prevented from being turned on, thus reducing or preventing damage to the data driver 120. Herein, a second driving voltage AVSS may be a ground voltage or a voltage less than the ground voltage.

Figure 6A:
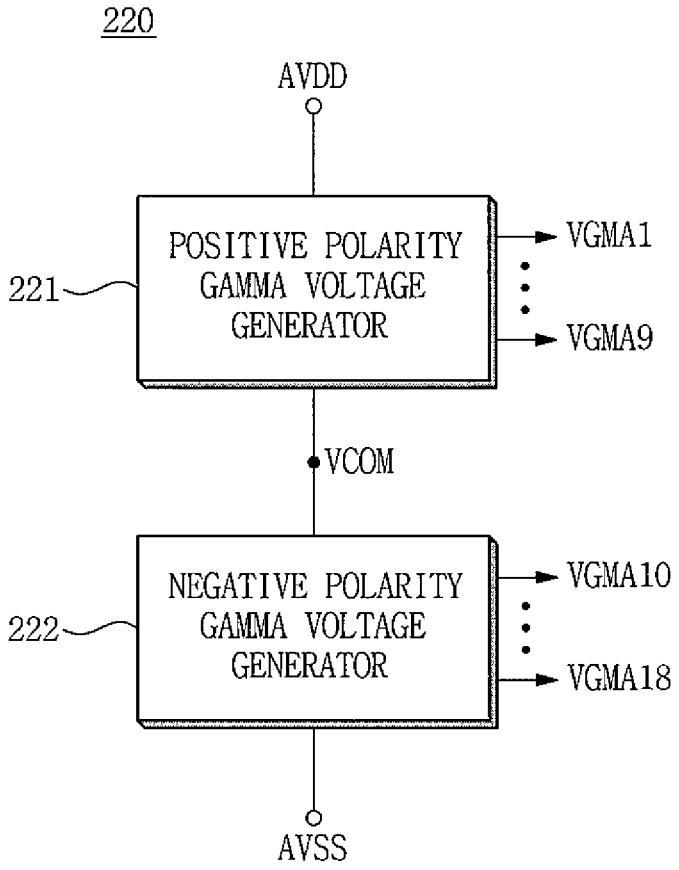
FIG. 6A is a block diagram illustrating a gamma voltage generator in a power management integrated circuit of FIG. 1.
Figure 6B:
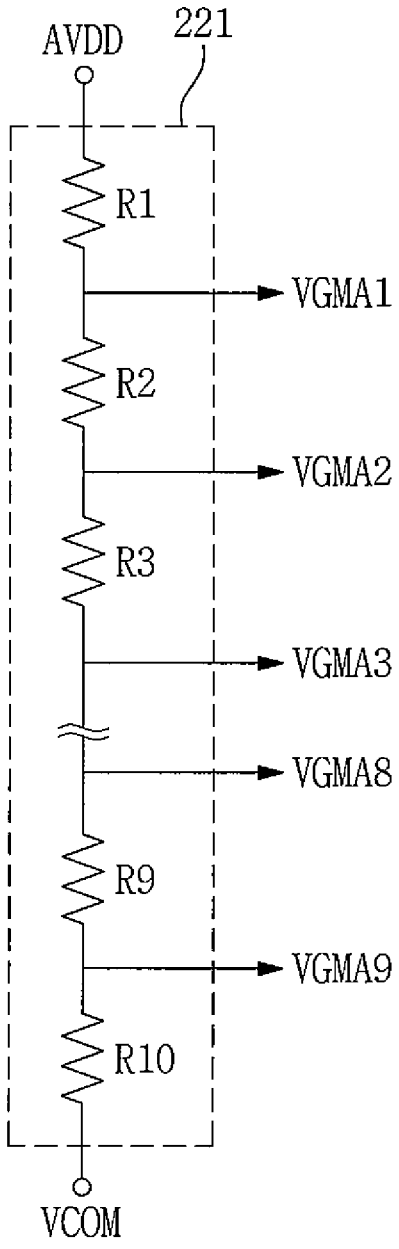
FIG. 6B is a circuit diagram illustrating a positive-polarity gamma voltage generator of FIG. 6A.

FIG. 6A is a block diagram illustrating a gamma voltage generator 220 in a power management integrated circuit of FIG. 1. FIG. 6B is a circuit diagram illustrating the positive-polarity gamma voltage generator 220 of FIG. 6A.

As illustrated in FIG. 6A, the gamma voltage generator 220 in the PMIC 210 may include a first reference gamma voltage generator 221 and a second reference gamma voltage generator 222. For example, the first reference gamma voltage generator 221 may generate a plurality of reference gamma voltages VGMA1 to VGMA9 having a positive polarity (+) between the driving voltage AVDD and a common voltage VCOM, and the second reference gamma voltage generator 222 may generate a plurality of reference gamma voltages VGMA10 to VGMA18 having a negative polarity (−) between the common voltage VCOM and the second driving voltage AVSS.

As illustrated in FIG. 6B, the first reference gamma voltage generator 221 may include a plurality of resistors R1 to R10 that are connected in series between the driving voltage AVDD and the common voltage VCOM. The reference gamma voltages VGMA1 to VGMA9 having a positive polarity (+) may have different voltage levels between the driving voltage AVDD and the common voltage VCOM, based on the voltage distribution principles. The second reference gamma voltage generator 222 may include a plurality of resistors that are connected in series between the common voltage VCOM and the second driving voltage AVSS.

That is, the data driver 120 converts the digital image data signal RGB into analog image signals corresponding thereto using the reference gamma voltages VGMA1 to VGMA9 having a positive polarity (+) and the reference gamma voltages VGMA10 to VGMA18 having a negative polarity (−), and applies the converted analog image signals to the data lines DL1 to DLm.

One of the reference gamma voltages VGMA1 to VGMA9 having a positive polarity (+), for example, the reference gamma voltage VGMA1 (hereinafter, "first gamma voltage), which has a highest voltage level may have a constant voltage difference with respect to the driving voltage AVDD. In addition, one of the reference gamma voltages VGMA1 to VGMA9 having a positive polarity (+), for example, the reference gamma voltage VGMA9 (hereinafter, "ninth gamma voltage), which has a lowest voltage level may have a constant voltage difference with respect to the common voltage VCOM.

One of the reference gamma voltages VGMA10 to VGMA18 having a negative polarity (−), for example, the reference gamma voltage VGMA10 (hereinafter, "tenth gamma voltage), which has a highest voltage level may have a constant voltage difference with respect to the common voltage VCOM. In addition, one of the reference gamma voltages VGMA10 to VGMA18 having a negative polarity (−), for example, the reference gamma voltage VGMA18 (hereinafter, "eighteenth gamma voltage), which has a lowest voltage level may have a constant voltage difference with respect to the second driving voltage AVSS.

Thus, according to the exemplary embodiment, the voltage detector 310 may calculate the voltage difference VGAP' by detecting the voltage-dropped driving voltage AVDD' and the voltage-dropped first reference gamma voltage VGMA1'. In addition, the voltage detector 310 may calculate the voltage difference VGAP' by detecting the common voltage VCOM and the voltage-dropped ninth reference gamma voltage VGMA9' or the common voltage VCOM and the voltage-dropped tenth reference gamma voltage VGMA10', or may calculate the voltage difference VGAP' by detecting the second driving voltage AVSS and the voltage-dropped eighteenth gamma voltage VGMA18'.

Hereinafter, another exemplary embodiment of the present invention will be described with reference to FIGS. 7A, 7B, and 8. Configurations similar or identical to the configurations of the exemplary embodiment will be represented by the same reference numerals, and the repeated description may not be provided or may be described briefly.

Figure 7A:
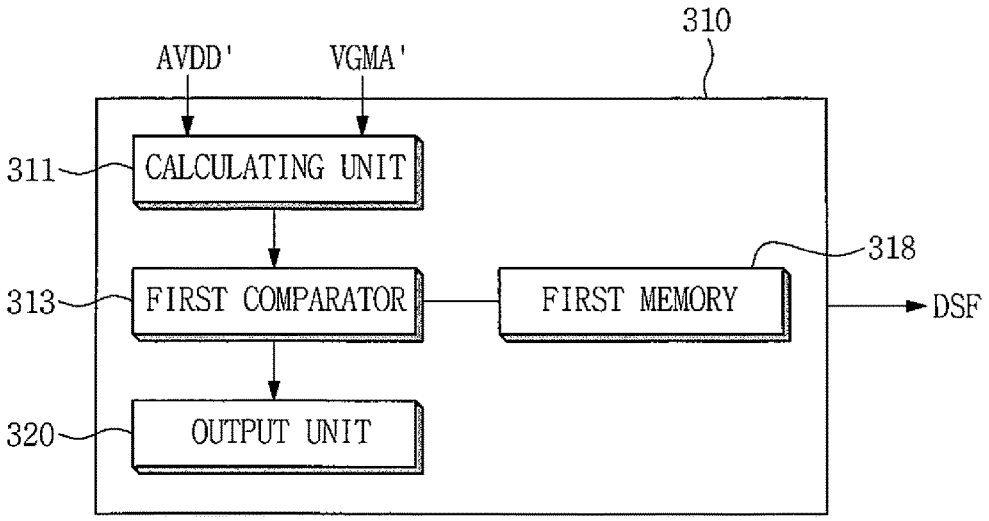
FIG. 7A is a block diagram illustrating a voltage detector of a display device according to another exemplary embodiment of the present invention.

As illustrated in FIG. 7A, a voltage detector 310 includes a calculating unit 311, a first comparator 313, a first memory 318, and an output unit 320.

The calculating unit 311 calculates a voltage difference VGAP' between a voltage-dropped driving voltage AVDD' and a voltage-dropped gamma voltage VGMA' input from a data driver 120.

The first comparator 313 compares the voltage difference VGAP' calculated in the calculating unit 311 and a reference voltage difference VGAP stored in a first memory 318. In the present exemplary embodiment, the reference voltage difference VGAP is described as being about 0.2 V, but the present invention is not limited thereto. In alternative exemplary embodiments, the reference voltage difference VGAP may be set to have other suitable values.

Figure 8:
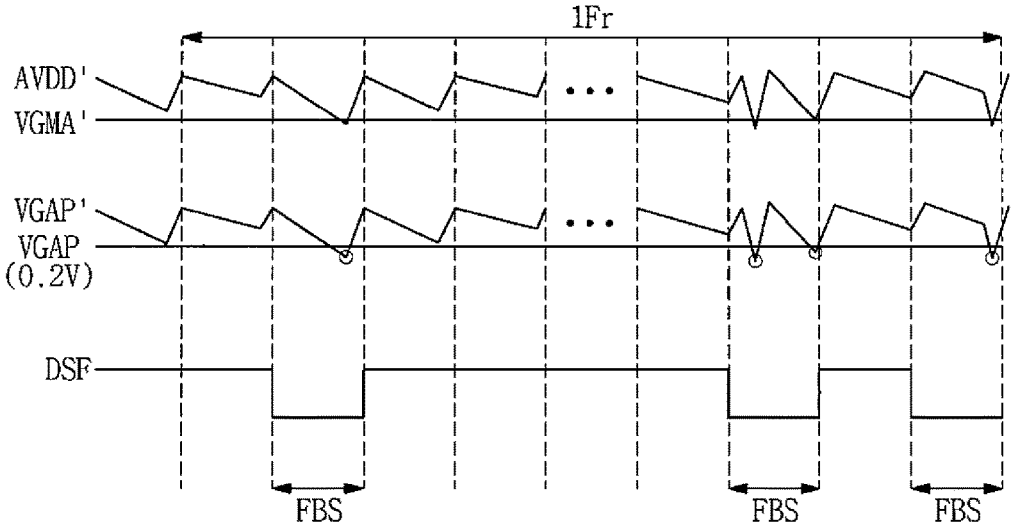
FIG. 8 is a diagram illustrating waveforms of signals used to adjust a driving voltage and a gamma voltage of the display device according to another exemplary embodiment of the present invention.

As illustrated in FIG. 8, the output unit 320 outputs a driver status signal DSF to the power adjustor 410. In this regard, in a case where the calculated voltage difference VGAP' is less than the reference voltage difference VGAP, a feedback signal FBS is output to the power adjustor 410.

For example, the output unit 320 may generate a high signal in a case where the voltage difference VGAP' calculated in the first comparator 313 is greater than the reference voltage difference VGAP stored in the first memory 318, and generate a low signal in a case where the voltage difference VGAP' calculated in the first comparator 313 is less than the reference voltage difference VGAP stored in the first memory 318, so as to apply the signal to the power adjustor 410. In this case, the low signal may be a feedback signal FBS.

However, the present exemplary embodiment is not limited thereto, and the output unit 320 may generate a low signal in a case where the voltage difference VGAP' calculated in the first comparator 313 is greater than the reference voltage difference VGAP stored in the first memory 318, and generate a high signal in a case where the voltage difference VGAP' calculated in the first comparator 313 is less than the reference voltage difference VGAP stored in the first memory 318. In this case, the high signal may be the feedback signal FBS.

Figure 7B:
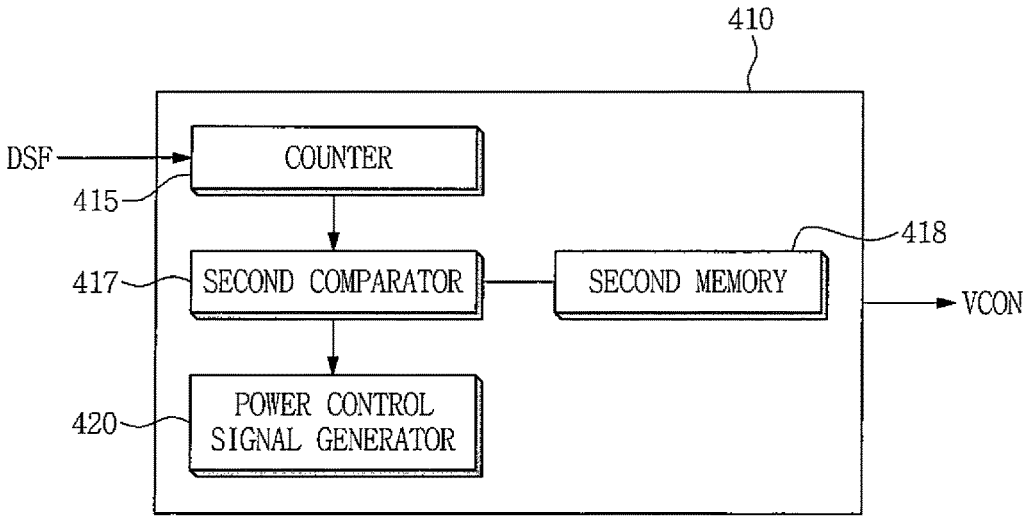
FIG. 7B is a block diagram illustrating a power adjustor of the display device according to another exemplary embodiment of the present invention.

As illustrated in FIG. 7B, the power adjustor 410 includes a counter 415, a second comparator 417, a second memory 418, and a power control signal generator 420.

The counter 415 counts the number of the feedback signal FBS input from the voltage detector 310 to thereby increase a count number. In this case, the counter 415 initiates the stored count number when a single frame 1Fr ends.

The second comparator 417 compares the count number calculated by the counter 415 to the reference count number stored in the second memory 418. The reference count number may be set in various manners. For example, the reference count number may be set to be two.

The power control signal generator 420 outputs the control signal CONT to the PMIC 210. In this regard, in a case where the calculated count number is greater than the reference count number stored in the second memory 418, the power control signal VCON is output to the PMIC 210.

For example, the power control signal generator 420 may generate a high signal in a case where the count number calculated in the second comparator 417 is less than the reference count number stored in the second memory 418, and generate a low signal in a case where the count number calculated in the second comparator 417 is greater than the reference count number stored in the second memory 418, so as to apply the signal to the PMIC 210. In this case, the low signal may be the power control signal VCON.

However, the present exemplary embodiment is not limited thereto, and the power control signal generator 420 may generate a low signal in a case where the count number calculated in the second comparator 417 is less than the reference count number stored in the second memory 418, and generate a high signal in a case where the count number calculated in the second comparator 417 is greater than the reference count number stored in the second memory 418. In this case, the high signal may be the power control signal VCON.

In the exemplary embodiment, the power adjustor 410 calls the feedback signal FBS and applies the power control signal VCON in a direct manner, in addition to generating the power control signal VCON. To this end, the power adjustor 410 may include a serial communication interface, such as an inter-integrated circuit I2C, which allows transmission and/or reception of signals to and/or from the PMIC 210 and the voltage detector 310 through a serial communication bus.

That is, the serial communication interface forms a communication interface with the PMIC 210 and the voltage detector 310. The power adjustor 410 directly calls the feedback signal FBS of the voltage detector 310 through the serial communication interface, and directly generates the power control signal VCON. The power adjustor 410 directly applies the generated power control signal VCON to the PMIC 210 through the serial communication interface.

As set forth hereinabove, in the display device according to some exemplary embodiments, the driving voltage or the gamma voltage output from the PMIC are automatically adjusted so that a voltage difference between the voltage-dropped driving voltage and the voltage-dropped gamma voltage that are applied to the data driver are greater than a preset or predetermined reference voltage difference. Accordingly, the gamma voltage may have a voltage level invariably less than the voltage level of the driving voltage in the data driver, such that breakdown of the data driver due to formation of potential reversal may be prevented and reliability of the display device may be enhanced (e.g., increased).

From the foregoing, it will be appreciated that various embodiments in accordance with the present disclosure have been described herein for purposes of illustration, and that various modifications may be made without departing from the scope and spirit of the present teachings. Accordingly, the various embodiments disclosed herein are not intended to be limiting of the true scope and spirit of the present teachings, as defined by the following claims, and equivalents thereof.

It will be understood that, although the terms "first", "second", "third", etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section discussed below could be termed a second element, component, region, layer or section, without departing from the spirit and scope of the inventive concept.

The terminology used herein is for the purpose of describing particular embodiments and is not intended to be limiting of the inventive concept. As used herein, the singular forms "a" and "an" are intended to include the plural forms as well, unless the context clearly indicates otherwise. It will be further understood that the terms "include," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list. Further, the use of "may" when describing embodiments of the inventive concept refers to "one or more embodiments of the inventive concept." Also, the term "exemplary" is intended to refer to an example or illustration.

It will be understood that when an element or layer is referred to as being "on", "connected to", "coupled to", or "adjacent to" another element or layer, it can be directly on, connected to, coupled to, or adjacent to the other element or layer, or one or more intervening elements or layers may be present. When an element or layer is referred to as being "directly on," "directly connected to", "directly coupled to", or "immediately adjacent to" another element or layer, there are no intervening elements or layers present.

As used herein, the term "substantially," "about," and similar terms are used as terms of approximation and not as terms of degree, and are intended to account for the inherent variations in measured or calculated values that would be recognized by those of ordinary skill in the art.

As used herein, the terms "use," "using," and "used" may be considered synonymous with the terms "utilize," "utilizing," and "utilized," respectively.

The display device and/or any other relevant devices or components according to embodiments of the present invention described herein may be implemented utilizing any suitable hardware, firmware (e.g. an application-specific integrated circuit), software, or a suitable combination of software, firmware, and hardware. For example, the various components of the display device may be formed on one integrated circuit (IC) chip or on separate IC chips. Further, the various components of the display device may be implemented on a flexible printed circuit film, a tape carrier package (TCP), a printed circuit board (PCB), or formed on a same substrate. Further, the various components of the display device may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the scope of the exemplary embodiments of the present invention.

What is claimed is:

1. A display device comprising:

a power management integrated circuit configured to output a driving voltage and a gamma voltage, the gamma voltage being less than the driving voltage;

a timing controller configured to output an image data signal and a driving control signal;

a data driver configured to convert the image data signal to a data voltage signal based on the driving voltage, the gamma voltage, and the driving control signal;

a power connecting portion configured to connect the power management integrated circuit and the data driver;

a voltage detector configured to detect the driving voltage and the gamma voltage that are voltage-dropped in the power connecting portion, and to output a feedback signal; and a power adjustor configured to receive the feedback signal and to output a power control signal to the power management integrated circuit, the power management integrated circuit being further configured to adjust the driving voltage and the gamma voltage based on the power control signal, wherein the power adjustor comprises:

a memory configured to store a reference voltage difference and a reference count number;

a counter configured to calculate a count number by counting each instance of the feedback signal being less than the reference voltage difference; and a power control signal generator configured to output the power control signal when the count number is greater than the reference count number.

2. The display device of claim 1, wherein the feedback signal is a voltage difference between the voltage-dropped driving voltage and the voltage-dropped gamma voltage.

3. The display device of claim 2, wherein the counter is configured to initiate the count number for each frame.

4. The display device of claim 2, wherein the counter is configured to calculate the count number for each period of a horizontal synchronization signal.

5. The display device of claim 4, wherein the power management integrated circuit is configured to receive the power control signal and to increase the voltage difference between the driving voltage and the gamma voltage in a single frame.

6. The display device of claim 5, wherein the power management integrated circuit is configured to increase the driving voltage or to decrease the gamma voltage.

7. The display device of claim 6, wherein the power management integrated circuit is configured to initiate the driving voltage and the gamma voltage after a single frame ends.

8. The display device of claim 5, wherein the power management integrated circuit further comprises an additional power supply configured to increase power capacity of the driving voltage in response to the power control signal.

9. The display device of claim 8, wherein the additional power supply is configured to initiate the power capacity of the driving voltage after a single frame ends.

10. The display device of claim 1, wherein the power adjustor comprises a serial interface configured to transmit and/or receive the feedback signal and the power control signal in a serial communication scheme.

11. A display device comprising:

a power management integrated circuit configured to output a driving voltage and a gamma voltage, the gamma voltage being less than the driving voltage;

a timing controller configured to output an image data signal and a driving control signal;

a data driver configured to convert the image data signal to a data voltage signal based on the driving voltage, the gamma voltage, and the driving control signal;

a power connecting portion configured to connect the power management integrated circuit and the data driver;

a voltage detector configured to detect the driving voltage and the gamma voltage that are voltage-dropped in the power connecting portion, and to output a feedback signal; and a power adjustor configured to receive the feedback signal and to output a power control signal to the power management integrated circuit, the power management integrated circuit being further configured to adjust the driving voltage and the gamma voltage based on the power control signal, wherein the voltage detector comprises a first memory configured to store a reference voltage difference and outputs the feedback signal when a voltage difference between the driving voltage and the gamma voltage that are voltage-dropped is less than the reference voltage difference, and wherein the power adjustor comprises:

a second memory configured to store a reference count number;

a counter configured to count a count number in response to the feedback signal; and a power control signal generator configured to output the power control signal when the count number is greater than the reference count number.

12. The display device of claim 11, wherein the feedback signal is a logic signal having a high value or a low value.

13. The display device of claim 12, wherein the counter is configured to initiate the count number for each frame.

14. The display device of claim 13, wherein the power management integrated circuit is configured to receive the power control signal and to increase a voltage difference between the driving voltage and the gamma voltage in a single frame.

15. The display device of claim 14, wherein the power management integrated circuit is configured to increase the driving voltage or to decrease the gamma voltage.

16. The display device of claim 15, wherein the power management integrated circuit is configured to initiate the driving voltage and the gamma voltage after a single frame ends.

17. The display device of claim 14, wherein the power management integrated circuit further comprises an additional power supply configured to increase power capacity of the driving voltage in response to the power control signal.

18. The display device of claim 17, wherein the additional power supply is configured to initiate the power capacity after a single frame ends.

* * * * *